US005879456A

United States Patent [19]

Curran

[11] Patent Number: 5,879,456

[45] Date of Patent: Mar. 9, 1999

[54] TUBE COATING SYSTEM

[76] Inventor: Ed Curran, 830 S. North Lake Dr., Hollywood, Fla. 33019-1311

[21] Appl. No.: 916,891

[22] Filed: Aug. 22, 1997

Related U.S. Application Data

[63] Continuation-in-part of Ser. No. 682,425, Jul. 17, 1996, abandoned.

[51] Int. Cl.[6] ..... B05B 13/06; B08B 3/00

[52] U.S. Cl. ..... 118/317; 134/167 C; 118/DIG. 10; 137/355.2

[58] Field of Search ..... 118/DIG. 10, 215, 118/317, 306; 137/355.17–355.22; 451/76; 134/166 C, 167 C, 168 C, 167 R; 15/302

[56] References Cited

U.S. PATENT DOCUMENTS

| | | | |
|---|---|---|---|
| 2,191,728 | 2/1940 | Purcell et al. | 118/215 |
| 2,679,434 | 5/1954 | Herrmann | 137/355.19 |
| 3,050,078 | 8/1962 | Hooper | 137/355.19 |
| 3,394,730 | 7/1968 | Masters | 137/355.17 |
| 3,606,862 | 9/1971 | Huff et al. | 118/DIG. 10 |
| 3,939,862 | 2/1976 | Booth | 137/355.19 |
| 4,216,738 | 8/1980 | Muta | 118/DIG. 10 |
| 4,368,091 | 1/1983 | Ontsuga et al. | 118/215 |
| 4,723,568 | 2/1988 | Adams | 137/355.17 |
| 4,838,302 | 6/1989 | Prange | 1347/355.22 |
| 4,993,443 | 2/1991 | Buchert | 137/355.22 |
| 5,139,751 | 8/1992 | Mansfield et al. | 118/DIG. 10 |

*Primary Examiner*—David A. Simmons
*Assistant Examiner*—Calvin Padgett
*Attorney, Agent, or Firm*—Panitch, Schwarze, Jacobs & Nadu, P.C.

[57] ABSTRACT

An integrated system for coating an inner wall surface of a tube is disclosed. A hose has an applicator nozzle attached at a forward end thereof. A payout guide is drivingly engaged with the hose to drive and to remove the hose and the applicator nozzle into and through and from the tube, respectively. A fluid supply system is in fluid communication with the hose, and includes a fluid source supplying a fluid to the hose and applicator nozzle, and a supply valve interposed between the fluid source and the applicator nozzle for selectively applying the supplied fluid to the applicator nozzle. A control system is connected to the payout guide to control the driving and removing of the hose and to the supply valve to control application of the supplied fluid to the applicator nozzle. The payout guide is positionable with respect to the tube by a sole operator, the control system includes a control actuator positioned adjacent the payout guide, and the control actuator is actuatable by the sole operator while the payout guide is being positioned thereby. The payout guide is suspended from a position adjustment assembly for adjusting a position thereof. The control system includes a first control for controlling the removing of the hose and a second independent control for controlling the supply valve.

17 Claims, 5 Drawing Sheets

TUBE COATING SYSTEM

CROSS-REFERENCE TO RELATED APPLICATION

This is a continuation-in-part of U.S. patent application Ser. No. 08/682,425, filed Jul. 17, 1996, now abandoned.

FIELD OF THE INVENTION

The invention relates to an assembly for feeding and automatically distributing a substance on the inside of tubes and pipes, and more particularly to a system for semi-automatically coating and painting the inner wall surfaces of tubes, particularly in heat exchanger and condenser tube arrays.

BACKGROUND OF THE INVENTION

Tubes and pipes are naturally quite inaccessible with regard to their inner wall surfaces. The surfaces are usually coated by immersing the tube into a liquid bath and rotating the tube. These procedures are not available when the tube is integrated in a heat exchanger array or the like. Condensers in power plants, for instance, often have tube arrays with hundreds of parallel and closely spaced pipes. These pipes are accessible only from the header or footer plates.

Condenser tubes are subject to extreme heat differentials, to corrosive media, and to solids deposits. During service, the tube walls are slowly abraded or corroded and subject to deposits forming thereon. The inner wall surfaces must therefore be cleaned from time to time and the protective coating on the inner wall surface must be refurnished to prevent further corrosion or abrasion and to diminish fouling.

SUMMARY OF THE INVENTION

It is accordingly an object of the invention to provide a tube coating system which overcomes the disadvantages of the prior art devices and methods and which allows quick and accurate application of coating material to the inner wall surface of a tube, and particularly to a multiple tube array. It is a further object of the invention to provide a system which can be converted with only simple means to an assembly for sandblasting (abrasive cleaning) or hydroblasting the inner wall surfaces of tubes.

In the present invention, an integrated system for coating an inner wall surface of a tube has a flexible hose, a payout guide, a fluid supply system, and a control system. The hose has an applicator nozzle attached at a forward end thereof. The payout guide is drivingly engaged with the hose to drive the hose and the applicator nozzle into and through the tube and removing the hose and the applicator nozzle from the tube. The fluid supply system is in fluid communication with the hose, and includes a source of fluid for supplying a fluid to the hose and applicator nozzle, and a supply valve interposed between the source of fluid and the applicator nozzle for selectively applying the supplied fluid to the applicator nozzle. The control system is operatively connected to the payout guide to control the driving and removing of the hose and nozzle applicator and to the supply valve to control application of the supplied fluid to the applicator nozzle.

In one preferred embodiment of the present invention, the payout guide is positionable with respect to the tube by a sole operator, the control system includes at least one control actuator positioned adjacent the payout guide, and the control actuator is actuatable by the sole operator while the sole operator is positioning the payout guide with respect to the tube. In another preferred embodiment of the present invention, a position adjustment assembly is provided for adjusting a position of the payout guide, and the payout guide is suspended from the position adjustment assembly. In still another preferred embodiment of the present invention, the control system includes a first control for controlling the removing of the hose and nozzle applicator and a second control independent from the first control for controlling the supply valve.

Other features which are considered as characteristic for the invention are set forth in the appended claims. Although the invention is illustrated and described herein as embodied in a condenser tube cleaning system, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DETAILED DESCRIPTION OF PREFERRED EMBODIMENT

Figure 1:
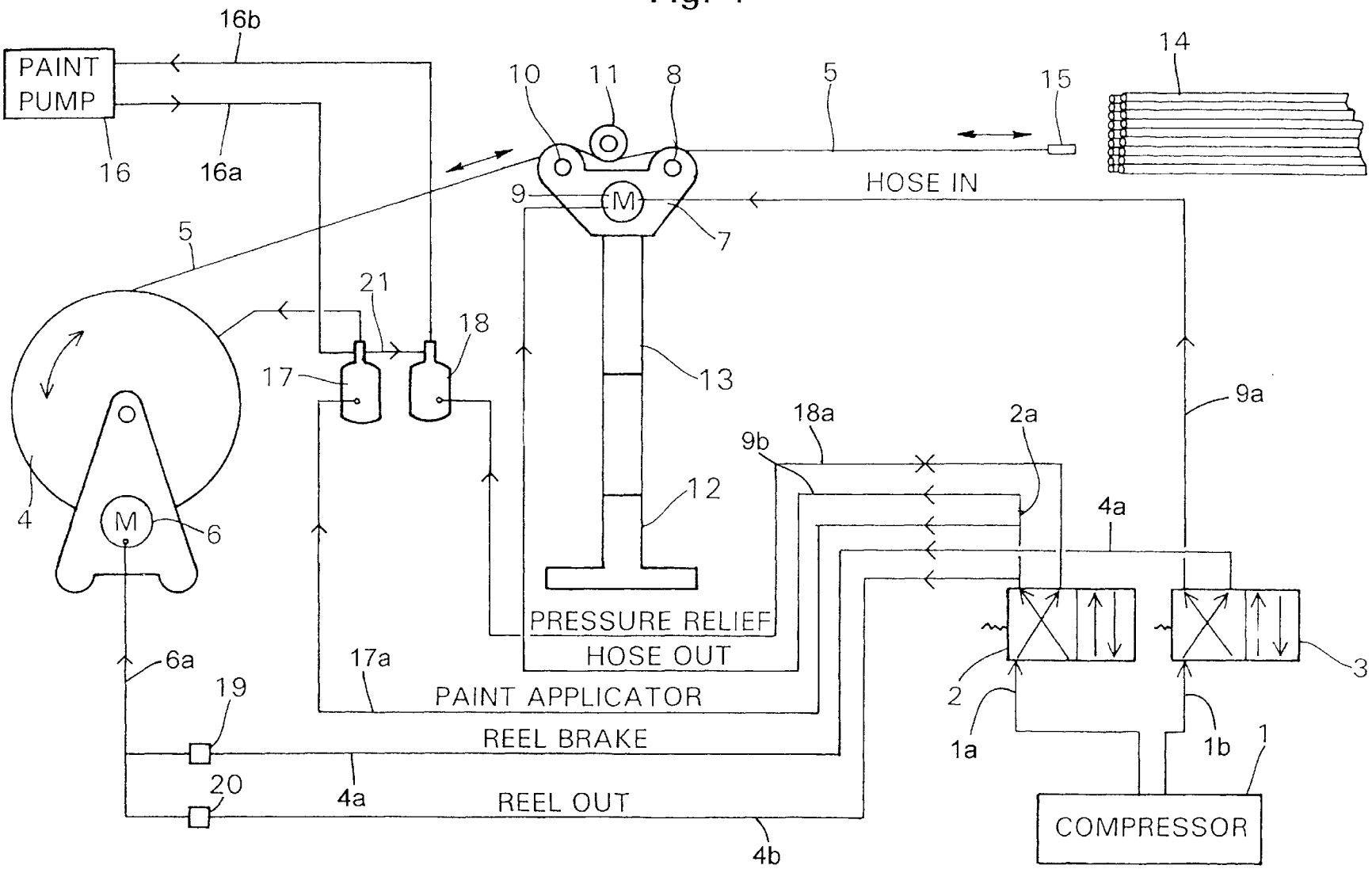
FIG. 1 is a diagrammatic illustration of one embodiment of the system of the invention.

Referring now to the figures of the drawing in detail and first, particularly, to the pneumatic diagram of FIG. 1 thereof, the system is supplied with pressurized air from an air compressor 1. The compressor 1 preferably supplies constant pneumatic pressure of about 6.8 atm (100 psi). A control system comprising a valve array (2, 3) formed with two air valves 2 and 3 connects the compressor 1 to the applicator system of the invention. The air valves 2 and 3 are substantially identically formed, foot-pedal operated valves. As will become clear from the following description, the valve 3 is connected so as to effect the insertion of the applicator nozzles into the tubes and the valve 2 is connected so as to effect the withdrawal of the applicator nozzles and the simultaneous spray coating of the tube walls.

A rotatably supported hose reel 4 holds a defined length of paint spray hose 5. In the preferred embodiment, the reel 4 is defined with three segments which each hold the same amount of hose 5. Accordingly, three hoses 5 are simultaneously paid out from the reel 4. The reel 4 is driven by an air motor 6, which is pneumatically connected to both valves 2 and 3. It should be understood that the reel 4 may also be driven manually or with an electrical motor.

The hose 5 is paid out from the reel 4 to a pay-out guide 7 which, in structure, is similarly constructed with a wire measurer. A forward roller 8 of the payout guide 7 is driven with an air motor 9, which effects the paying-out of the hose 5. The hose 5 is thereby clamped between the driven forward roller 8 and a rearward roller 10 on the one hand, and a clamping roller 11 on the other hand. The clamping roller 11 is preferably biased downwardly with a non-illustrated spring. The pay-out guide 7 is supported on a stand 12 with a telescoping column 13. The latter allows quick height adjustments so as to assure that the guide 7 feeds the hose into a respective condenser tube 14 at approximately the right vertical position.

The forward tip of the hose 5 is provided with an applicator nozzle and check-valve 15, which will be explained in more detail in the following text.

An paint applicator system includes a paint pump 16 connected to the hose 5 through a high-pressure spray gun valve 17 and a pressure relief valve 18, and through a non-illustrated manifold inside the reel 4. A first fluid conduit 16*a* extends from the paint pump 16 to the spray gun valve 17. A second fluid conduit 16*b* extends from the pressure relief valve 18 to the paint pump 16. The pressure system is thus independent of the pneumatic loop which includes the compressor 1, the valves 2, 3, and the motors 6, 9. First and second air conduits 1*a* and 1*b* extend from the compressor 1 to the valves 2 and 3, respectively, to supply the valves 2 and 3 with a source of compressed air.

Referring now more particularly to the pneumatic loop system, all of the lines in the preferred embodiment are ⅜" lines. The valve 3, as noted above, is the in-valve. For that purpose, the valve 3 connects to the motor 9 via first motor air hose 9*a* for driving the roller 8 forward (clockwise as shown). Upon a actuation of the foot pedal (not shown) of the valve 3, to move the valve 3 to the left of the position shown in FIG. 1 to align the schematically shown vertically extending parallel conduits in the valve 3 with the first motor air hose 9*a* and the reel brake air hose 4*a* to thereby supply compressed air to the first motor air hose 9*a* and exhaust air from the reel brake air hose 41 such that the roller 8 is driven by the motor 9 and hose 5 is paid out from the reel 4. The reel brake air hose 4*a* is in fluid communication with the motor 6 via a common motor hose 6*a*. In the pay-out position of the valve 3, the reel 4 is free to rotate and the hose 5 is essentially pulled from the reel by the roller 8.

When the foot pedal of the valve 3 is released, to the position shown in FIG. 1 air is supplied to the motor 6 which acts as a brake. In other words, the reel brake via the reel brake air hose 4*a* and a common motor hose 6*a* while exhausting air from the first motor air hose 9*a* prevents extra hose 5 from being paid out once the applicator nozzle 15 has reached the other side of the tube or the defined payout length has been attained. The strength of the reel brake is adjusted at a valve 19, which defines the amount of air allowed through the respective line and thus the effective brake power of the motor 6.

Once the required length of the hose 5, i.e. the hoses 5, has been paid out and the reel 4 has come to a stop, the system is ready for coating application. At that point, the valve 2 is actuated by depressing its foot pedal (not shown) to move the valve 2 to the left of the position shown in FIG. 1 to align schematically shown vertically extending parallel conduits in the valve 2 with a common conduit 2*a* that is in fluid communication with a second motor air hose 9*b*, a paint applicator air hose 17*a* and a reel out air hose 4*b* to thereby supply compressed air to the second motor air hose 9*b*, the paint applicator air hose 17*a*, and the reel out air hose 4*b*. The reel out air hose 4*b* is in fluid communication with the motor 6 via the common motor hose 6*a*. This causes the motor 9 to reverse its direction and pull the hose 5 from the tubes 14. The motor 6 is actuated at the same time, so as to wind the hose 5 back onto the reel 4, and the paint applicator spray gun valve 17 is triggered. Paint from the paint pump 16 is thereby dispensed through the hose 5 and the applicator nozzle 15. The necessary pulling power of the motor 6 may be adjusted at a valve 20. In the preferred embodiment, the valve 19 is adjusted so that the motor 6 runs at about 0.4 kW (0.5 hp) and the valve 20 (together with the continuous feed through the valve 19) allows full power of approximately 3 kW (4 hp).

The hoses 5 are preferably marked with delimiters which allow the operator to quite accurately anticipate when the applicator nozzle is about to be pulled from the tube 14. At that point the valve 2 is released and moves to the right into the position shown in FIG. 1 to align the schematically shown vertically extending criss-crossed conduits in the valve 2 such that the air within the common conduit 2*a* is exhausted and compressed air is supplied to the pressure relief valve hose 18*a*. Thus, the forced flow to the motor 6 (through 20), to the spray gun valve 17, and to the motor 9 is stopped. Due to the pressure build-up in the paint loop of up to several thousand psi (4000 psi in the preferred embodiment)—the flexible hoses 5 expand slightly during paint application, for example—it is necessary to immediately vent the same. This is effected by opening the pressure relief valve 18, by application of the compressed air through the pressure relief hose 18 *a* which allows the over pressure and excess paint to bleed through a pressure relief jumper 21 and back to the paint pump 16 or a bleed container. This allows the pressure in the high-pressure paint loop to decrease very quickly until the check valve at the applicator nozzle 15 is closed. The result is minimal bleed of coating paint once the pedal at the valve 2 has been released.

The paint pump 16 may be chosen from any number of pumps which are commercially available. Applicant incorporated a 204 atm (3000 psi) 30:1 ratio pump available from GRACO, Inc. of Minneapolis, Minn. in the preferred embodiment.

Figure 2:
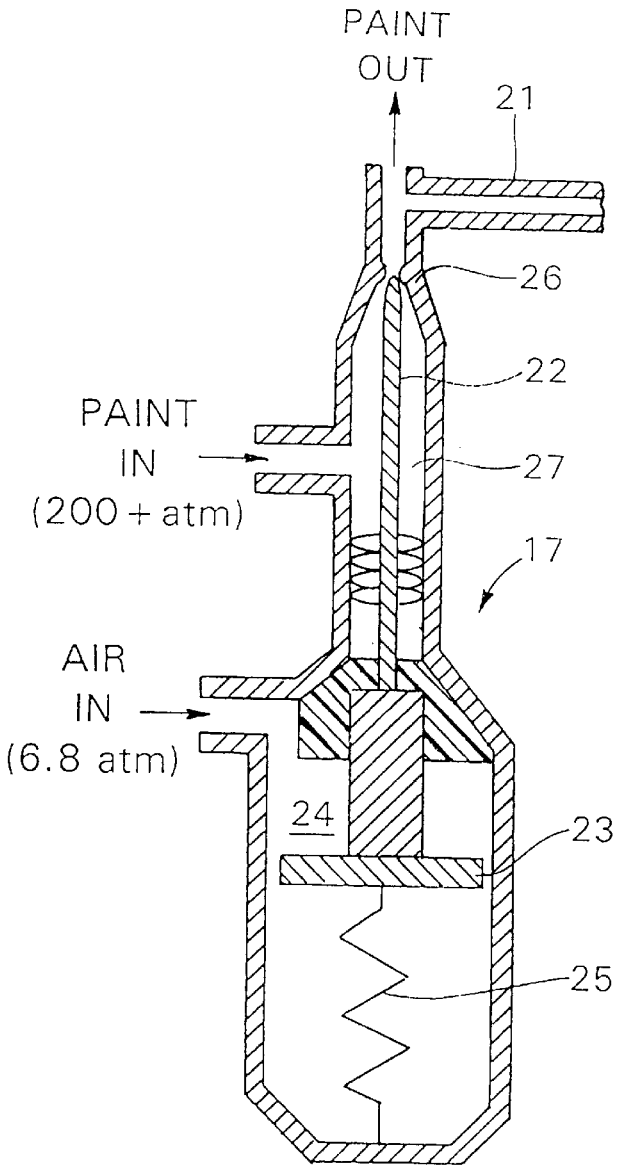
FIG. 2 is a sectional view of a high-pressure spray gun valve.

The spray gun and pressure relief valves 17 and 18 may be identical and are rated at 270 atm (4000 psi). They are available, for instance, under the trademark AutoJet®. Referring to FIG. 2, which illustrates such an air-operated automatic spray gun valve, a valve needle 22 is actuated by a pneumatically operated piston 23. The piston 23 is thereby subjected to the pressure of the pneumatic loop when the valve 2 is triggered. Pressurized air enters a cylinder chamber 24 and forces the piston 23 downwardly against the force of a biasing spring 25. As the volume in the cylinder chamber 24 increases and the piston 23 moves downwardly (in the reference frame of FIG. 2), the valve needle 22 is lifted from a valve seat 26 at its forward tip. Coating material, i.e. the paint, which is forced into a needle chamber 27 from the paint pump 16, issues at a spray tip 28 in a substantially atomized form. From the spray tip 28 the paint is forced through the armature at the reel 4 and into the hoses 5.

Figure 3:
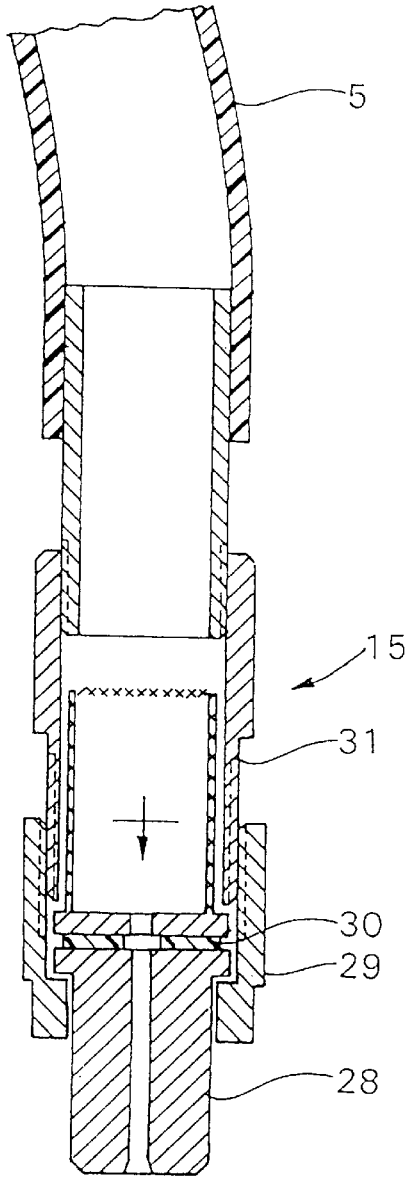
FIG. 3 is a sectional view of an applicator nozzle.

At the tip of each of the hoses 5 there is provided a paint spray applicator nozzle 15, which is formed with a spray nozzle and a check valve. With reference to FIG. 3, the hose 5 is tightly connected to the applicator tip 15, which includes a spray tip 28, a high-pressure tip retainer 29, a tip gasket 30, a strainer 31, and other non-essential connectors. A check valve is built into the strainer 31. The check valve of the preferred embodiment is rated at about 2.4 atm (40 psi), which ensures quick shutoff of the paint application, i.e. only minimal after-flow. The applicator system is commercially available, for instance under the trademark UniJet®.

A basic reel assembly 4, 6 is commercially available from Reelcraft Industries, Inc. of Columbia City, Ind. The reel 4, as mentioned above, may be driven electrically, pneumatically, or by means of a hand crank. The preferred embodiment, however, uses an air-driven motor 6. While the commercially available reel is available only for a single hose, i.e. with a single hose connector, it is understood that the armature must be branched so as to allow connection of as many hoses as required. The preferred embodiment of the invention has been tested as a triple-hose system. The hose connector assembly at the reel thus was branched into three connectors with a triple tee branch and the spool cylinder was divided with two divider vanes.

The air motors 6 and 9 are commercially available from GAST. The air motor 6 may also be purchased together with the reel 4.

Figure 4:
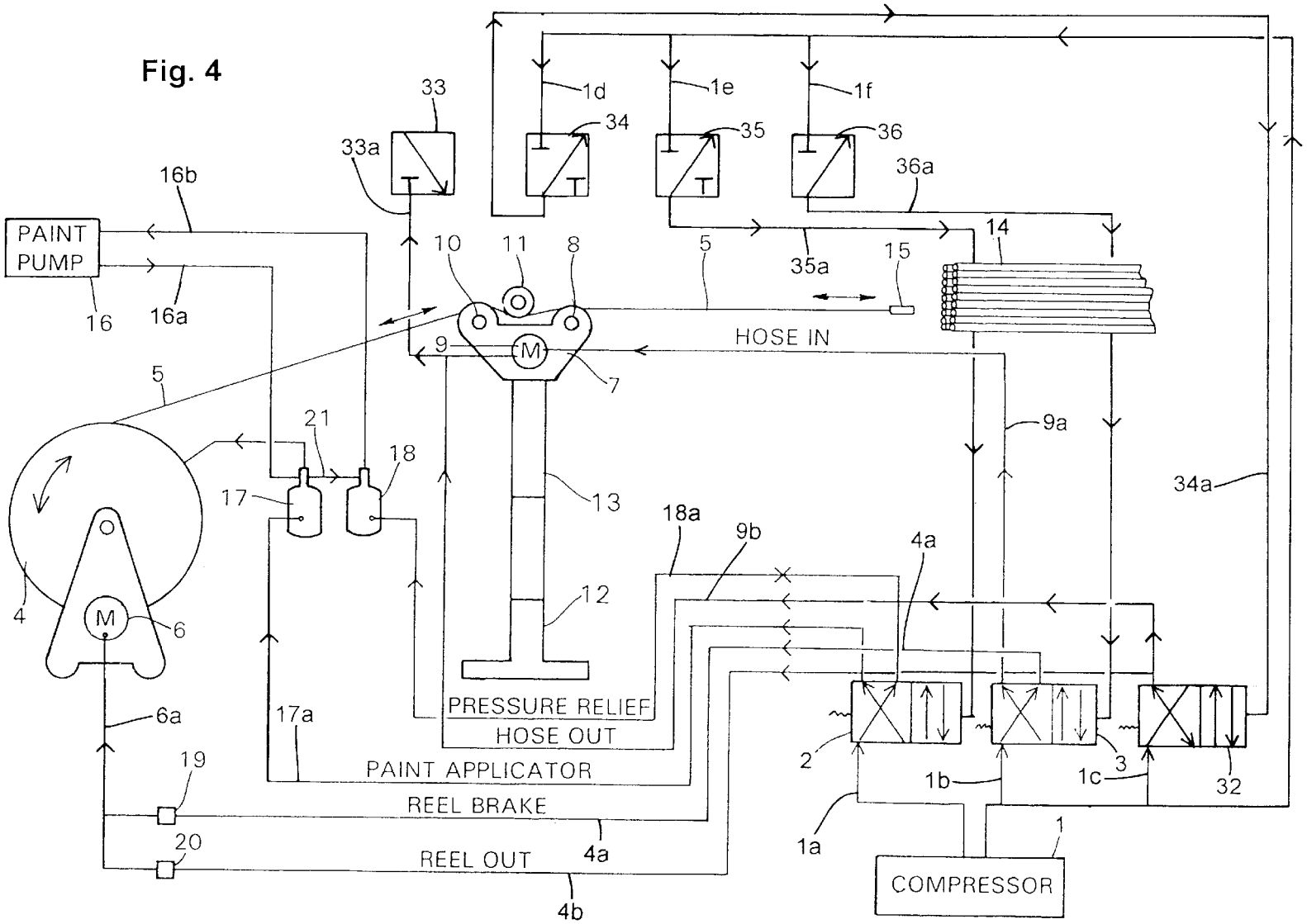
FIG. 4 is a diagrammatic illustration of an another embodiment of the system of the invention.

In another embodiment of the present invention, and referring now to FIG. 4, the functions: (a) of causing the motor 9 to reverse its direction and pull the hose 5 from tubes 14 ("hose out" in FIGS. 1 and 4); and (b) of actuating the motor 6 at the same time so as to wind the hose 5 back onto the reel 4 ("reel out" in FIGS. 1 and 4) are moved from the valve 2 to a third valve 32. Accordingly, the triggering of the paint applicator spray gun 17 by valve 2 may be performed independently of the pulling of the hose 5 from the tubes 14. As may be understood, such independent triggering is preferable since there may be a short delay from the time the spray gun 17 is triggered until paint is actually ejected from the applicator nozzle 15, especially inasmuch as pressure must build up in the hose 5, paint must travel the length of the hose 5, etc. Specifically, if the triggering of the paint applicator spray gun 17 and the pulling out of the hose 5 from the tubes 14 are performed together, as is the case in FIG. 1, the aforementioned short delay in paint ejection may result in a short initial length of tube 14 not receiving paint from the applicator nozzle 15. In the embodiment shown in FIG. 4, such a situation is avoided by allowing an operator to delay pulling of the hose 5 from the tubes 14 until the application of paint has actually begun.

Figure 5B:
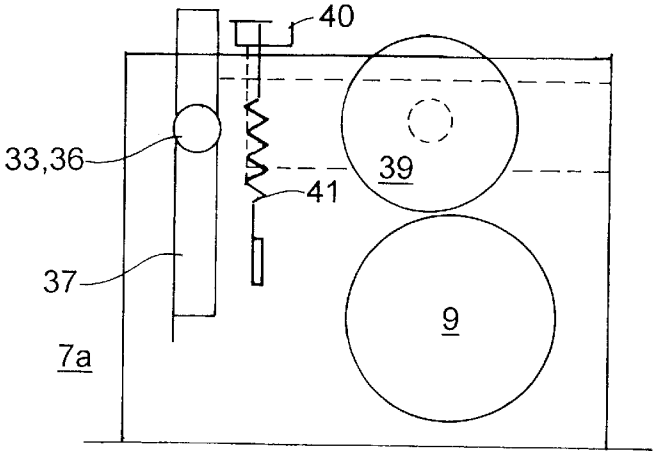
FIGS. 5*a,* 5*b* and 5*c* are front, side and top views, respectively, of a payout guide assembly of the invention.
Figure 5A:
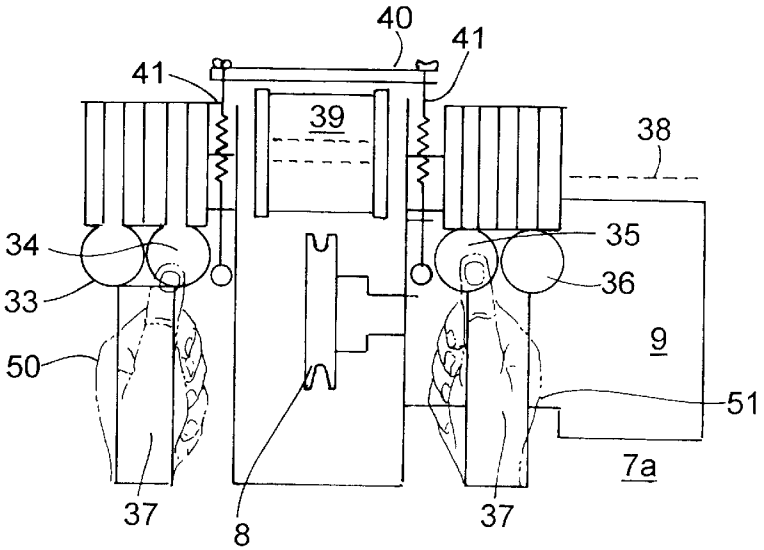
Figure 5C:
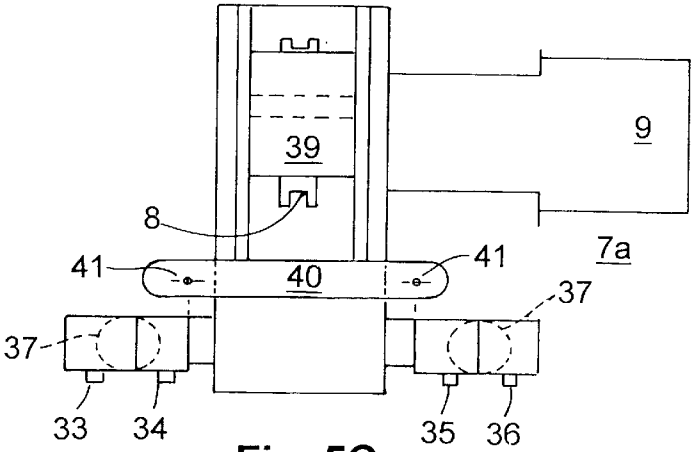

The embodiment shown in FIG. 4 also includes four finger-actuated valves 33–36. As seen in FIGS. 5A–5C, in another embodiment of the pay-out guide 7*a,* the finger valves 33–36 are positioned on the pay-out guide 7*a* so that a sole operator of the tube coating system may both position the pay-out guide 7*a* and actuate the valves 2, 3, 32 by way of the fingertip valves 33–36. Accordingly, and in contrast with the embodiment shown in FIG. 1, two operators are not necessary, one to operate the valves 2, 3, 32 and another to position the pay-out guide 7*a*.

As seen in FIG. 4, the fingertip valves 34, 35, 36 are control actuators that respectively air actuate the valves 32, 2, 3. Accordingly, the valves 2, 3, 32 must be air-actuatable. Third, fourth, fifth, and sixth air conduits 1*c,* 1*d,* 1*e,* and 1*f* extend from the compressor 1 to an air valve 32 and control actuators 34, 35, and 36, respectively, to supply the air valve 32 and control actuators 34, 35, and 36, respectively, with a source of compressed air. Seventh, eighth, and ninth air conduits 34*a,* 35*a,* and 36*a* extend from control actuators 34, 35, and 36, respectively, to air valves 32, 2, and 3, respectively, with a source of compressed air. Such air-actuatable valves are likely not also foot-pedal operated, although it is to be appreciated that if such air actuatable valves 2, 3, 32 are also foot-pedal operated, the tube coating system can be operated by one or two operators.

As also seen in FIG. 4, the fingertip valve 33 vents back pressure from the motor 9 on the pay-out guide 7, 7*a* through a back pressure hose 33*a.* More particularly, and as one skilled in the art will recognize, when the compressor 1 drives the motor 9 through actuated valve 3 (i.e., when the pay-out guide 7, 7*a* is paying out the hose 5 into the tube 14), a back pressure develops in the air motor 9, and such back pressure has the effect of slowing the air motor 9. With the fingertip valve 33, such back pressure may be vented, thereby increasing the speed of the air motor 9. As should now be understood, the fingertip valve 33 is operated in conjunction with the fingertip valve 36 (and the valve 3) to in effect provide a two-speed air motor 9.

Referring again to FIG. 5A, it is seen that the fingertip valves 33–36 are arranged in a particular order on the pay-out guide 7*a.* The left hand 50 of the sole operator operates fingertip valves 33 and 34 and the right hand 51 of the sole operator operates fingertip valves 35 and 36. However, one skilled in the art will appreciate that such fingertip valves 33–36 may be arranged in any suitable order without departing from the spirit and scope of the present invention. One skilled in the art will also appreciate that the fingertip valves 33–36 may be any of several fingertip valves without departing from the spirit and scope of the present invention. For example, the fingertip valves may be SPEEDAIRE single air pilot control valves.

As shown in FIGS. 5A–5C, the pay-out guide 7*a* includes a pair of handles 37, one arranged on either side of the forward roller 8. As should be understood, such handles 37 allow an operator to move and position the pay-out guide 7*a.* As shown in FIGS. 5A–5C, such handles 37 are also adjacent to the fingertip valves 33–36 such that an operator grasping the handles 37 may thumb-actuate the valves 33–36. In addition, and as best seen in FIG. 5A, the handles 37 and valves 33–36 are preferably rotatable about an axis 38 in a unitary manner and then locked at the adjusted position. Accordingly, and as should be understood, the handles 37 and valves 33–36 may be rotated to an ergonomically appropriate position depending on the working height of the pay-out guide 7*a* with respect to an operator thereof.

As seen in FIGS. 5A–5C, the rearward roller 10 and clamping roller 11 shown in FIG. 1 is replaced by an idler roller 39. Accordingly, it should now be appreciated that the pay-out guide 7, 7*a* may incorporated any of a number of different kind of roller configurations without departing from the spirit and scope of the present invention.

Figure 6:
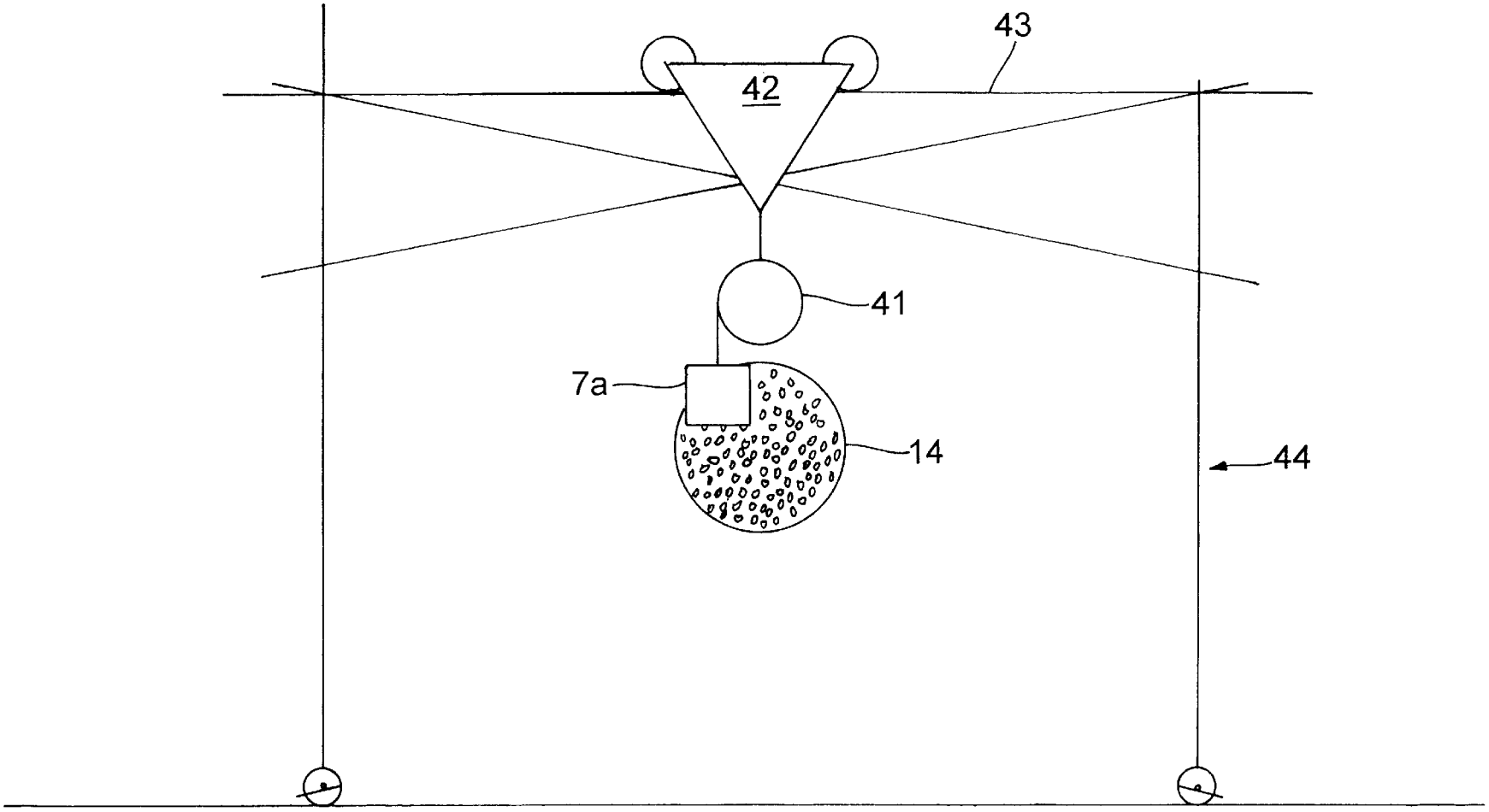
FIG. 6 is a block elevation view of a positioning assembly of the invention.

As seen in FIGS. 5A, 5B, and 6, the pay-out guide 7*a* is preferably suspended from an overhead support 40 by way of an appropriate suspension device 41 such that the pay-out guide 7*a* may be vertically adjusted. Accordingly, the stand 12 and telescoping column 13 shown in FIG. 1 are not necessary in the embodiment of the pay-out guide 7*a* shown in FIGS. 5A–5C. Moreover, one skilled in the art will recognize that any of a number of different vertical adjustment means may be employed to vertically adjust the pay-out guide 7, 7*a* without departing from the spirit and scope of the present invention.

For example, and turning now to FIG. 6, the suspension device 41 may be a spring-loaded tool balancer. As is known, such a tool balancer 41 has a wound cable attached to and is weighted by the pay-out guide 7*a* such that the cable is pulled out and unwound from the balancer 41 when the pay-out guide 7*a* is pulled downwardly, and such that the balancer automatically retracts and rewinds the cable and moves the pay-out guide 7*a* upwardly when the minimal pressure is released. An example of such a tool balancer 41 is an AERO-MOTIVE industrial tool balancer, although one skilled in the art will recognize that any of a number of other tool balancers may be employed without departing from the spirit and scope of the present invention.

As also seen in FIG. 6, the tool balancer 41 is preferably suspended from a horizontally adjustable trolley 42 that travels along a generally horizontal bar 43. As seen, the bar 43 is part of a temporary scaffolding 44, although one skilled in the art will recognize that the trolley 42 may travel along other types of horizontal surfaces without departing from the spirit and scope of the present invention. For example, the trolley 42 may travel along an already-existing overhead beam. One skilled in the art will recognize that any of a number of kinds of trolleys may be employed without departing from the spirit and scope of the present invention. For example, the trolley may be a wheeled heavy duty trolley, or for lighter duty may simply be a length of cable positioned over and slidable along the horizontal bar 43.

Preferably, and still referring to FIG. 6, the scaffolding 44 shown is positioned transversely with respect to a plurality of the tubes 14, and specifically at one end of the tubes 14, where the ends of each of some at least some of the tubes 14 are open. Accordingly, the pay-out guide 7*a* may be adjusted both horizontally, by way of the trolley 42, and vertically, by way of the balancer 41, with respect to each of the tubes 14.

One skilled in the art will recognize with respect to any embodiment of the present invention that the reel 4 and related equipment (motor 6, etc.) may be removed without departing from the spirit and scope of the present invention. In such a case, the hose 5 may simply be left on the ground before and after tube insertion and removal. Alternatively, the hose 5 may be a self-coiling hose.

It should be understood that the system which has been illustrated and described herein can be converted to a sandblasting or hydroblasting system for cleaning the tubes by removing deposits and corrosive blisters. The pneumatic arrangements described remain the same. The high-pressure paint loop is thereby replaced with a sandblasting loop (low pressure of not more than 20 atm) and the applicator nozzle is replaced with a sandblasting tip.

I claim:

1. An integrated system for coating an inner wall surface of a tube, the system comprising:

a flexible hose having an applicator nozzle attached at a forward end thereof;

a payout guide drivingly engaged with the hose for driving the hose and the applicator nozzle into and through the tube and removing the hose and the applicator nozzle from the tube, the payout guide being positionable with respect to the tube by a sole operator;

a fluid supply system in fluid communication with the hose, the fluid supply system including a source of fluid for supplying a fluid to the hose and applicator nozzle, and a supply valve interposed between the source of fluid and the applicator nozzle for selectively applying the supplied fluid to the applicator nozzle; and a control system operatively connected to the payout guide for controlling the driving and removing of the hose and nozzle applicator and to the supply valve for controlling application of the supplied fluid to the applicator nozzle, the control system including at least one control actuator positioned adjacent the payout guide, the control actuator being actuatable by the sole operator while the sole operator is positioning the payout guide with respect to the tube.

2. The system of claim 1 wherein the payout guide including a payout motor and a payout device driven by the payout motor.

3. The system of claim 1 wherein the control system is a pneumatic control system including a pneumatic compressor, wherein the pneumatic compressor is in fluid communication with at least one pneumatic control valve, wherein the at least one pneumatic control valve is energized by the pneumatic compressor, wherein the at least one control actuator is a pneumatic actuator valve energized by the compressor, the pneumatic actuator valve being in fluid communication with the at least one pneumatic control valve, wherein the pneumatic actuator valve controls the at least one pneumatic control valve, wherein the payout guide is pneumatically powered and is controlled by the at least one pneumatic control valve, and wherein the supply valve is a pneumatically operated supply valve controlled by the at least one pneumatic control valve.

4. The system of claim 1 comprising a hose reel having the flexible hose wound thereon, and a reel motor operatively connected to the hose reel for driving the hose reel, the reel motor being operatively connected to the control system for controlling the driving and removing of the flexible hose.

5. The system of claim 4 wherein the control system is a pneumatic control system including a pneumatic compressor and at least one pneumatic control valve energized by the pneumatic compressor, wherein the at least one control actuator is a pneumatic actuator valve energized by the compressor, the pneumatic actuator valve controlling the at least one pneumatic control valve, and wherein the reel motor is a pneumatically powered motor controlled by the at least one pneumatic control valve.

6. The system of claim 1 wherein the at least one control actuator is fingertip actuatable by the sole operator.

7. The system of claim 6 further including at least one handle mounted on the payout guide adjacent the at least one fingertip actuatable control actuator, the at least one handle being graspable by the sole operator while the sole operator is positioning the payout guide with respect to the tube and while the sole operator is fingertip actuating the at least one control actuator.

8. An integrated system for coating an inner wall surface of a tube, the system comprising:

a flexible hose having an applicator nozzle attached at a forward end thereof;

a payout guide drivingly engaged with the hose for driving the hose and the applicator nozzle into and through the tube and removing the hose and the applicator nozzle from the tube;

a position adjustment assembly for adjusting a position of the payout guide, the payout guide being suspended from the position adjustment assembly;

a fluid supply system attached to the hose, the fluid supply system including a fluid source supplying a fluid to the hose and applicator nozzle and a supply valve interposed between the fluid source and the applicator nozzle for selectively applying the supplied fluid to the applicator nozzle; and a control system operatively connected to the payout guide for controlling the driving and removing of the hose and nozzle applicator and to the supply valve for controlling application of the supplied fluid to the applicator nozzle.

9. The system of claim 8 wherein the position adjustment assembly includes a vertical position adjustment mechanism for adjusting a vertical position of the payout guide and a horizontal position adjustment mechanism for adjusting a horizontal position of the payout guide, whereby the payout guide is alignable with tubes located at different vertical positions and different horizontal positions.

10. The system of claim 9 wherein the vertical position adjustment mechanism comprises a suspended retracting cable.

11. The system of claim 9 wherein the horizontal position adjustment mechanism comprises a suspended trolley.

12. The system of claim 8 wherein the payout guide includes a payout motor and a payout device driven by the payout motor.

13. The system of claim 9 wherein the control system is a pneumatic control system including a pneumatic compressor in fluid communication with at least one pneumatic control valve, the at least one pneumatic control valve being energized by the pneumatic compressor, wherein the payout motor is in fluid communication with the at least one pneumatic control valve and is a pneumatically powered motor controlled by the at least one pneumatic control valve, and wherein the supply valve is a pneumatically operated supply valve controlled by the at least one pneumatic control valve.

14. The system of claim 8 further comprising a hose reel having the flexible hose wound thereon, and a reel motor operatively connected to the hose reel for driving the hose reel, the reel motor being operatively connected to the control system for controlling the driving and removing of the flexible hose.

15. The system of claim 14 wherein the control system is a pneumatic control system including a pneumatic compressor in fluid communication with at least one pneumatic control valve, the at least one pneumatic control valve being energized by the pneumatic compressor, and wherein the reel motor is a pneumatically powered motor controlled by the at least one pneumatic control valve.

16. An integrated system for coating an inner wall surface of a tube, the system comprising:

a flexible hose having an applicator nozzle attached at a forward end thereof;

a payout guide drivingly engaged with the hose for driving the hose and the applicator nozzle into and through the tube and removing the hose and the applicator nozzle from the tube;

a fluid supply system attached to the hose, the fluid supply system including a fluid source supplying a fluid to the hose and applicator nozzle and a supply valve interposed between the fluid source and the applicator nozzle for selectively applying the supplied fluid to the applicator nozzle; and a control system operatively connected to the payout guide for controlling the driving and removing of the hose and nozzle applicator and to the supply valve for controlling application of the supplied fluid to the applicator nozzle, the control system including a first control for controlling the removing of the hose and nozzle applicator and a second control independent from the first control for controlling the supply valve, the control system being a pneumatic control system including a pneumatic compressor, a first pneumatic control valve in fluid communication with and energized by the pneumatic compressor, and a second pneumatic control valve independent from the first pneumatic control valve in fluid communication with and energized by the pneumatic compressor, wherein the payout guide is driven by a pneumatically powered motor controlled by first pneumatic control valve, and wherein the supply valve is a pneumatically operated supply valve controlled by the second pneumatic control valve.

17. The system of claim 16 wherein the payout guide includes a payout motor and a payout device driven by the payout motor.

* * * * *